US006114996A

United States Patent [19]

Nghiem

[11] Patent Number: 6,114,996

[45] Date of Patent: Sep. 5, 2000

[54] INCREASED BANDWIDTH PATCH ANTENNA

[75] Inventor: David Nghiem, Houston, Tex.

[73] Assignee: Qualcomm Incorporated, San Diego, Calif.

[21] Appl. No.: 08/825,543

[22] Filed: Mar. 31, 1997

[51] Int. Cl.[7] ..... H01Q 1/38; H01Q 1/24

[52] U.S. Cl. ..... 343/700 MS; 343/702

[58] Field of Search ..... 343/700 MS, 702, 343/846, 848, 815

[56] References Cited

U.S. PATENT DOCUMENTS

| | | | |
|---|---|---|---|
| 4,040,060 | 8/1977 | Kaloi | 343/700 MS |
| 5,075,691 | 12/1991 | Garay et al. | 343/700 MS |
| 5,365,246 | 11/1994 | Rasinger et al. | 343/702 |
| 5,420,596 | 5/1995 | Burrell et al. | 343/700 MS |
| 5,614,915 | 3/1997 | Webb | 343/846 |
| 5,644,319 | 7/1997 | Chen et al. | 343/702 |
| 5,680,144 | 10/1997 | Sanad | 343/700 MS |
| 6,008,762 | 12/1999 | Nghiem | 343/700 MS |

FOREIGN PATENT DOCUMENTS

| | | | |
|---|---|---|---|
| 5589873 | 11/1974 | Australia . | |
| 0177362 | 4/1986 | European Pat. Off. | H01Q 1/24 |
| 0332139 | 9/1989 | European Pat. Off. | H01Q 1/32 |
| 0604338 | 6/1994 | European Pat. Off. | H01Q 1/24 |
| 0777295 | 6/1997 | European Pat. Off. | H01Q 9/04 |
| 19512003 | 10/1995 | Germany | H01Q 1/38 |
| 9101577 | 2/1991 | WIPO | H01Q 1/38 |
| 9102386 | 2/1991 | WIPO | H01Q 1/24 |

OTHER PUBLICATIONS

"Internal Broadband Antenna for Hand–held Terminals with Reduced Gain in the Direction of the User's Head" by Fuhl et al.; Institute of Electrical and Electronics Engineers, vol. 2, No. CONF. 45, Jul. 25, 1995, pp. 848–852.

"2 GHz Compact Antennas on Handsets" by C. Sabatier; Institute of Electrical and Electronics Engineers, vol. 2, Jun. 18, 1995, pp. 1136–1139.

*Primary Examiner*—Tan Ho

*Attorney, Agent, or Firm*—Philip Wadsworth; Thomas M. Thibault; Gregory D. Ogrod

[57] ABSTRACT

An increased bandwidth patch antenna which includes first and second arms spaced by an air gap. The first and second arms are electrically connected by a bridge. A ground plane, which is approximately parallel to the first and second arms, is separated from the first and second arms by a dielectric substrate. In one embodiment of the present invention, the first arm is a radiating arm and the second arm is a tuning arm. By varying the length of the tuning arm, the bandwidth of the antenna is increased. The second arm, which also acts as a parasitic arm of the first arm, increases the gain of the antenna. A signal unit is electrically coupled to the bridge. The signal unit transmits and/or receives signals having a selected frequency band. The antenna resonates at the selected frequency band.

8 Claims, 4 Drawing Sheets

INCREASED BANDWIDTH PATCH ANTENNA

CROSS-REFERENCE TO RELATED APPLICATIONS

This application is related to commonly-owned applications, filed concurrently herewith, entitled "Dual-Frequency-Band Patch Antenna With Alternating Active And Passive Elements" having application Ser. No. 08/825,542, now abandoned, and "Folded Quarter-Wave Patch Antenna" having application Ser. No. 08/825,544, now U.S. Pat. No. 6,008,762, which are incorporated herein by reference.

BACKGROUND OF THE INVENTION

I. Field of the Invention

The present invention relates generally to antennas and, more specifically, to an increased bandwidth patch antenna.

II. Description of the Related Art

Antennas are an important component of wireless communication systems. Although antennas may seem to be available in numerous different shapes and sizes, they all operate according to the same basic principles of electromagnetics. An antenna is a structure associated with a region of transition between a guided wave and a free-space wave, or vice versa. As a general principle, a guided wave traveling along a transmission line which opens out will radiate as a free-space wave, also known as an electromagnetic wave.

In recent years, with the rise in use of personal communication devices, such as PCS phones, cellular phones and other communication devices, the need for small antennas that are suitable for use in personal communication devices has increased. An important factor to be considered in designing antennas for personal communication devices is the radiation pattern. In most applications, the communication device must be able to communicate in all directions. Therefore, the device must receive and transmit signals effectively in all directions. Consequently, in personal communication devices, it is essential that the antenna has an omnidirectional radiation pattern. Furthermore, the antenna must be compact in size in order to be suitable in a personal communication device.

One antenna commonly used in personal communication devices is the whip antenna. There are, however, several disadvantages associated with the whip antenna. Often, the whip antenna is subject to damage by catching on things. Even when the whip antenna is designed to be retractable in order to prevent such damage, it consumes scarce interior space. This results in less interior space being available for advanced features and circuits. Also, as personal communication devices such as cellular phones become smaller, the ability to use the whip antenna efficiently is being challenged.

Another antenna which may also be suitable for use in personal communication devices is the patch or microstrip antenna. The patch antenna was originally developed in the late 1960's for use with aircraft, missiles and other military applications requiring a thin or low-profile antenna. These applications required that the antenna neither disturb the aerodynamic flow nor protrude inwardly to disrupt the mechanical structure. The patch antenna satisfied these requirements.

The bandwidth of a patch antenna is proportional to the thickness of the dielectric substrate used. The thicker the substrate, the wider the antenna's bandwidth. In order to maintain desired bandwidth of personal communication devices, current patch antennas must have relatively thick substrates, which make them relatively bulky for personal communication devices. Since antennas in personal communication devices are required to be quite small in size, they would typically have thin substrates. Consequently, they would also have narrow bandwidth. Unfortunately, a narrow bandwidth restricts the utility of the antenna to a narrow frequency band. An increased bandwidth would allow personal communication devices to operate over a wider frequency band.

SUMMARY OF THE INVENTION

The present invention is directed to an increased bandwidth patch antenna. According to the present invention, the patch antenna includes a conductor plate having first and second arms. The first and second arms are spaced by an air gap. A bridge connects the first and second arms. A ground plane which is approximately parallel to the conductor plate is separated from the conductor plate by a dielectric substrate.

According to one embodiment of the present invention, the first arm is a radiating arm and the second arm is a tuning arm. The length of the radiating arm is set in relation to the wavelength $\lambda$ associated with the resonant frequency $f_0$. Commonly used lengths are $\lambda$, $\lambda/_2$ and $\lambda/_4$, although other lengths are possible. The length of the second arm is longer or shorter than that of the first arm. By varying the length of the second arm, the bandwidth of the antenna is increased. Furthermore, the second arm acts as a parasitic arm of the first arm, which increases the gain of the antenna. The parasitic arm also increases the bandwidth of the antenna by increasing its overall volume.

In another embodiment of the present invention, dual band operation is achieved by exciting the second arm by a second frequency band while the first arm is also being excited by a first frequency band. In this embodiment, the first and second arms are each excited with separate frequency bands. The first arm acts as a first active radiator and the second arm acts as a first tuning arm. Likewise, the second arm acts as a second active radiator and the first arm acts as a second tuning arm. The length of the first arm is set in relation to the first frequency band, while the length of the second arm is set in relation to the second frequency band.

One advantage of the present invention is that it provides an increased bandwidth and increased gain over conventional patch antennas. Another advantage of the present invention is that it provides dual frequency band operation.

Further features and advantages of the invention, as well as the structure and operation of various embodiments of the invention, are described in detail below with reference to the accompanying drawings.

BRIEF DESCRIPTION OF THE DRAWINGS

In the drawings, like reference numbers generally indicate identical, functionally similar, and/or structurally similar elements. The drawing in which an element first appears is indicated by the leftmost digit(s) in the reference number. The present invention will be described with reference to the accompanying drawings, wherein.

DETAILED DESCRIPTION OF THE PREFERRED EMBODIMENTS

Figure 1:
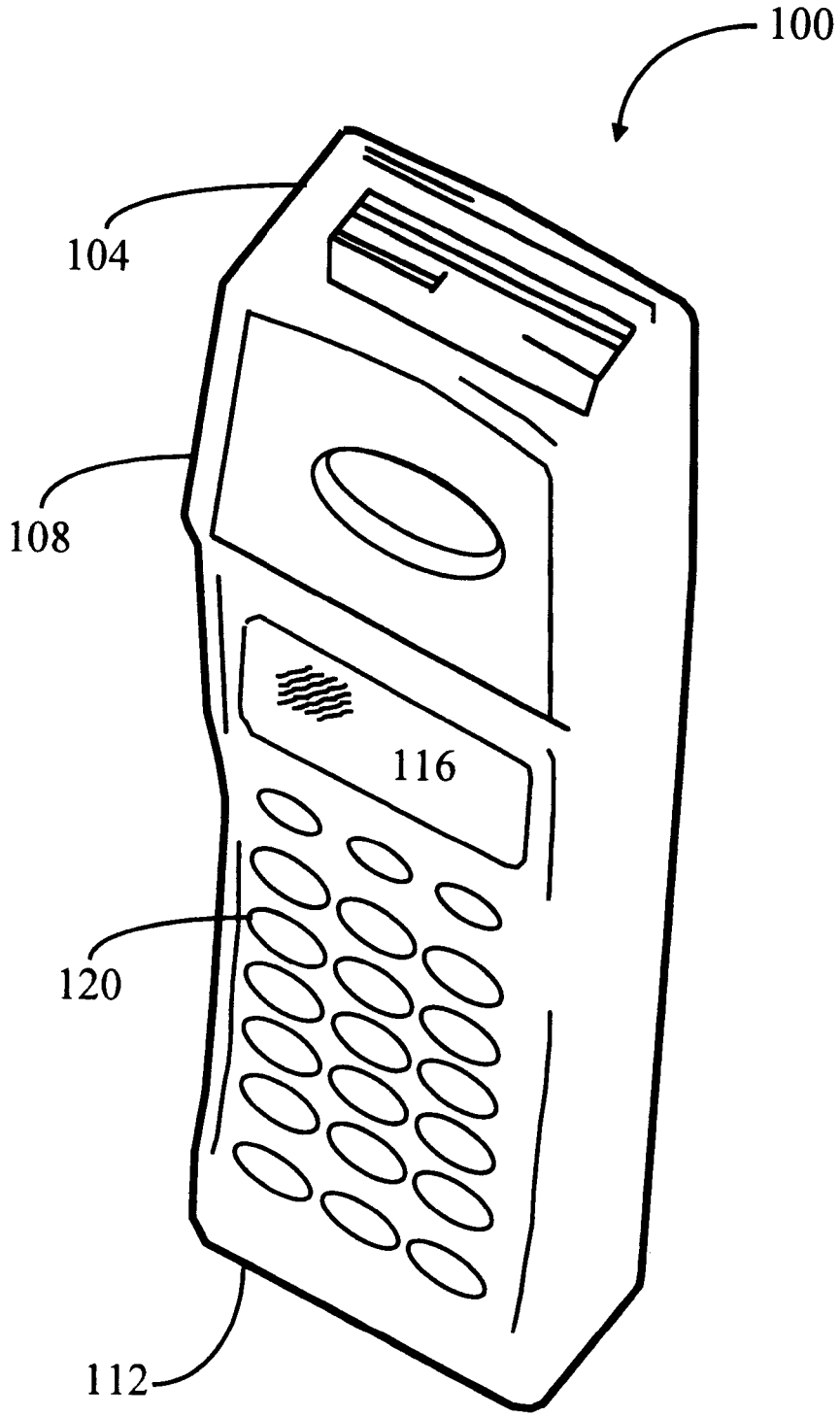
FIG. 1 illustrates a portable telephone utilizing the present invention.

1. Overview and Discussion of the Invention

As discussed earlier, the patch antenna was originally developed in the late 1960's for use with aircraft, missiles and other military applications requiring a thin or low-profile antenna. These applications required that the antenna neither disturb the aerodynamic flow nor protrude inwardly to disrupt the mechanical structure. The patch antenna satisfied these requirements.

These characteristics that make the patch antenna suitable for use in aircraft and missiles also make it suitable for use in hand-held and mobile personal communication devices. For example, the patch antenna can be built on the top surface of a personal communication device such as a cellular phone, or to a surface of a vehicle carrying a personal communication device, or built or mounted on some other device. This means that it can be manufactured with increased automation and decreased manual labor of installation. This decreases costs and increases reliability. Also, unlike the whip antenna, the patch antenna is less susceptible to damage by catching on things because it has a very low profile. Furthermore, since the patch antenna can be built on the personal communication device's top surface, it will not consume interior space which is needed for advanced features and circuits.

In addition, the patch antenna possesses other characteristics which make it suitable in personal communication devices. For example, the quarter-wave patch antenna, which is a version of a patch antenna, radiates an omnidirectional pattern into space above the ground plane, which makes it suitable in personal communication devices. Also at the frequency band over which the personal communication devices operate, the length of the quarter-wave patch antenna is quite short.

The bandwidth of the patch antenna is proportional to the thickness of the dielectric substrate used. The thicker the substrate, the wider the antenna's bandwidth. In order to maintain desired bandwidth of personal communication devices, current patch antennas must have relatively thick substrates, which make them relatively bulky for personal communication devices. Since antennas in personal communication devices are required to be quite small in size, they typically have thin substrates. Consequently, they have narrow bandwidth. Unfortunately, a narrow bandwidth restricts the utility of the antenna to a narrow frequency band. An increased bandwidth would allow the personal communication devices to operate over a wider frequency band.

The present invention provides a solution to this problem. The present invention allows a patch antenna to have increased bandwidth without requiring an increase in the thickness of its dielectric substrate. This allows the patch antenna to have a relatively small overall size, which makes it suitable in personal communication devices.

According to the present invention, the patch antenna includes a conductor plate having first and second arms. The first and second arms are approximately planar to each other and are spaced by an air gap. A bridge connects the first and second arms. A ground plane which is approximately parallel to the conductor plate is separated from the conductor plate by a dielectric substrate.

In one embodiment of the present invention, the first arm is a radiating arm and the second arm is a tuning arm. By varying the length of the tuning arm, the bandwidth of the antenna is increased. The second arm acts as a parasitic arm of the first arm, which increases the gain of the antenna. The parasitic arm also increases the bandwidth of the antenna by increasing the overall volume of the antenna.

The length of the radiating arm is set in relation to the wavelength $\lambda$ associated with the resonant frequency $f_0$. Commonly used lengths are $\lambda$, $\lambda/2$ and $\lambda/4$, although other lengths are possible.

The present invention is described in connection with a patch antenna having a length of $\lambda/4$, also known as a quarter-wave patch antenna. Although the present invention is described in connection with the quarter-wave patch antenna, its utility is not restricted merely to the quarter-wave patch antenna. In fact, those skilled in the art will recognize that the present invention may be utilized in a patch antenna having any length, such as a full-wave, half-wave or $n\lambda/4$, where n is an integer.

2. Example Environment

Before describing the invention in detail, it is useful to show an example environment in which the invention can be implemented. In a broad sense, the invention can be implemented in any personal communication device. One such environment is a portable telephone, such as that used for cellular, PCS or other commercial service.

FIG. 1 illustrates a portable phone 100. Specifically, FIG. 1 includes a patch antenna 104, a speaker 108, a microphone 112, a display 116 and a keyboard 120.

Antenna 104 is built into the top surface of portable phone 100. Since antenna 104 has a very low profile, it is not subject to damage by catching on things. Also, unlike a retractable whip antenna, antenna 104 does not consume interior space in portable phone 100. This results in more interior space being available for advanced features and electronics.

The present invention is described in terms of this example environment. Some specific application examples are discussed in terms of cellular and PCS frequencies. Description in these terms is provided for convenience only. It is not intended that the invention be limited to application in this example environment. In fact, after reading the following description, it will become readily apparent to a person skilled in the relevant art how to implement the invention in alternative environments, such as, for example, in automobiles, truck-trailer, other types of vehicles and hand-held devices.

3. A Conventional Quarter-Wave Patch Antenna

Figure 2:
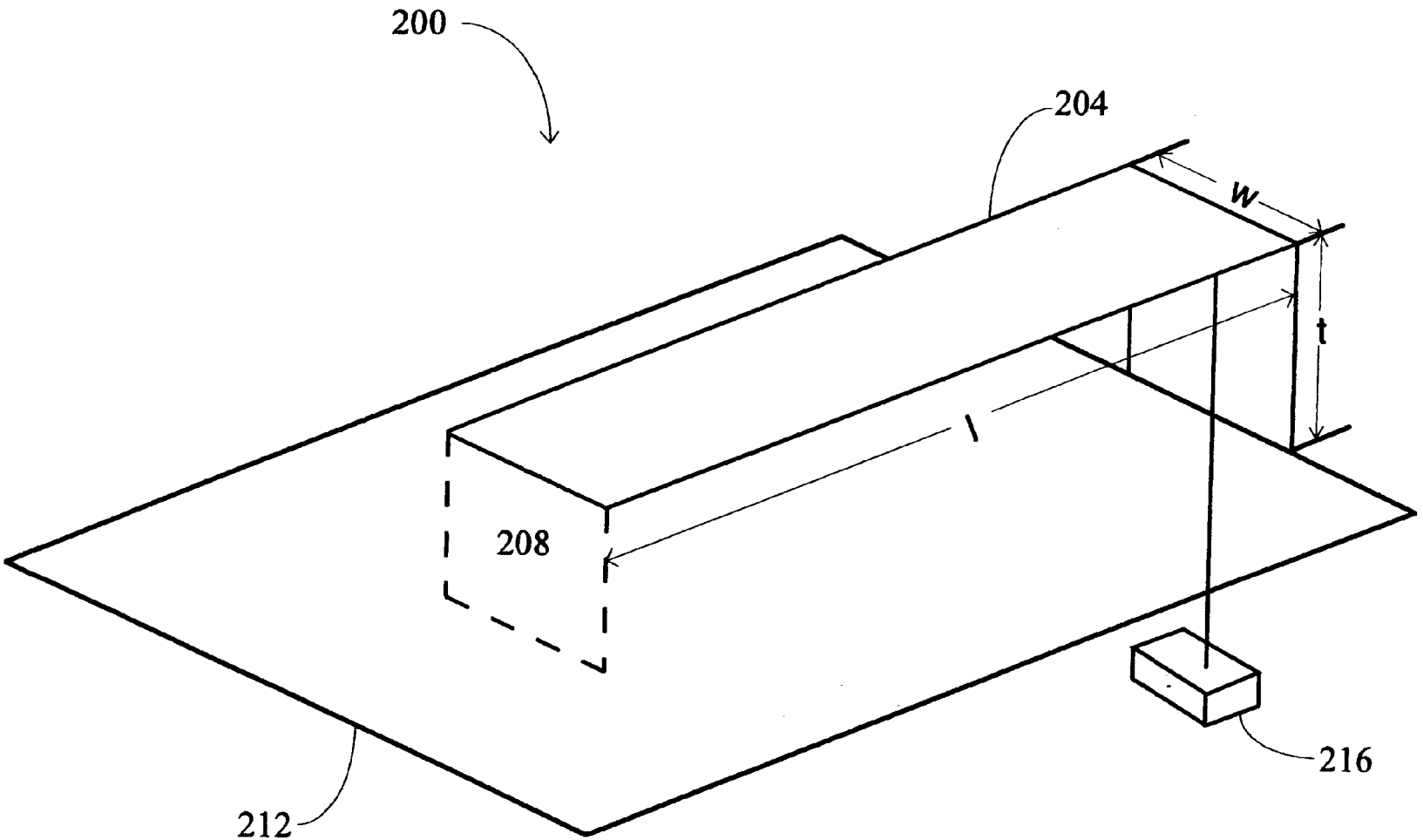
FIG. 2 Prior Art
FIG. 2 illustrates a conventional quarter-wave patch antenna.

FIG. 2 illustrates a conventional quarter-wave patch antenna 200. Specifically, FIG. 2 includes a conductor plate 204, a dielectric substrate 208, a ground plane 212 and a signal unit 216.

The length l of antenna 200 determines its resonant frequency. As a general rule, quarter-wave patch antenna 200 having a length l resonates at a frequency of c/(4l), where c is the speed of light. Thus, the resonant frequency of quarter-wave patch antenna 200 can be selected by selecting l. At or near the resonant frequency, quarter-wave patch antenna 200 radiates most effectively. Consequently, quarter wave patch antenna 200 is designed to operate at or near the resonant frequency. For example, at an operating frequency of approximately 1.9 GHz (PCS frequency), the wavelength $\lambda$ of the radio signal is approximately 7 inches. Thus, the length of antenna 200 is approximately 1.75 inches.

The height of antenna 200 is determined by the thickness t of dielectric substrate 208. The selected value of t is based on the bandwidth over which antenna 200 must operate. In addition, there are other factors which impact the value of t. If t is too large, the overall size of antenna 200 becomes too large, which makes antenna 200 undesirable for personal communication devices. Also, if t is too large, surface wave modes are excited which degrades the performance of antenna 200. If, on the other hand, t is too small, conductor plate 204 is too close to ground plane 212. This causes the surface current induced in ground plane 212 to be too strong which causes high ohmic loss. As a result, the efficiency of antenna 200 is degraded. In practice, the thickness t of dielectric substrate 208 is held at less than or equal to one-tenth of the wavelength in dielectric substrate 208 or $\lambda_g/_{10}$, where $\lambda_g=\lambda_0/\sqrt{\epsilon_{eff}}$, $\lambda_0$ is the wavelength in air and $\epsilon_{eff}$ is the dielectric constant in dielectric substrate 208.

The width w of antenna 200 should be less than a wavelength so that higher-order modes will not be excited. Moreover, in order to make the antenna suitable for a personal communication device, the width is usually kept relatively small.

Ground plane 212 is typically made of a conductive material such as gold, silver, copper, aluminum or brass. Other conductive materials may also be used. Ground plane 212 is separated from conductor plate 204 by dielectric substrate 208 and is approximately parallel to conductor plate 204. One end of conductor plate 216 is electrically connected to ground plane 212.

A probe is electrically connected to conductor plate 212. The probe, which may be a coaxial cable, passes through ground plane 212 and meets conductor plate 204 near an end. The probe couples signal unit 216 to conductor plate 204. Signal unit 216 provides a signal of a selected frequency band to conductor plate 204, which creates a surface current in conductor plate 204. The density of the surface current is high near the region of conductor plate 204 where the probe meets conductor plate 204 and decreases gradually along the length of conductor plate 204 in the direction away from the point where the probe meets conductor plate 204. In fact, the surface current is concentrated in the first half of conductor plate 204 and is negligible in the second half.

As discussed earlier, an increase in bandwidth of the quarter-wave patch antenna is desired. An increase in bandwidth of the antenna would enable a personal communication device to operate at a wider range of frequency.

4. Increased Bandwidth Patch Antenna

Figure 3:
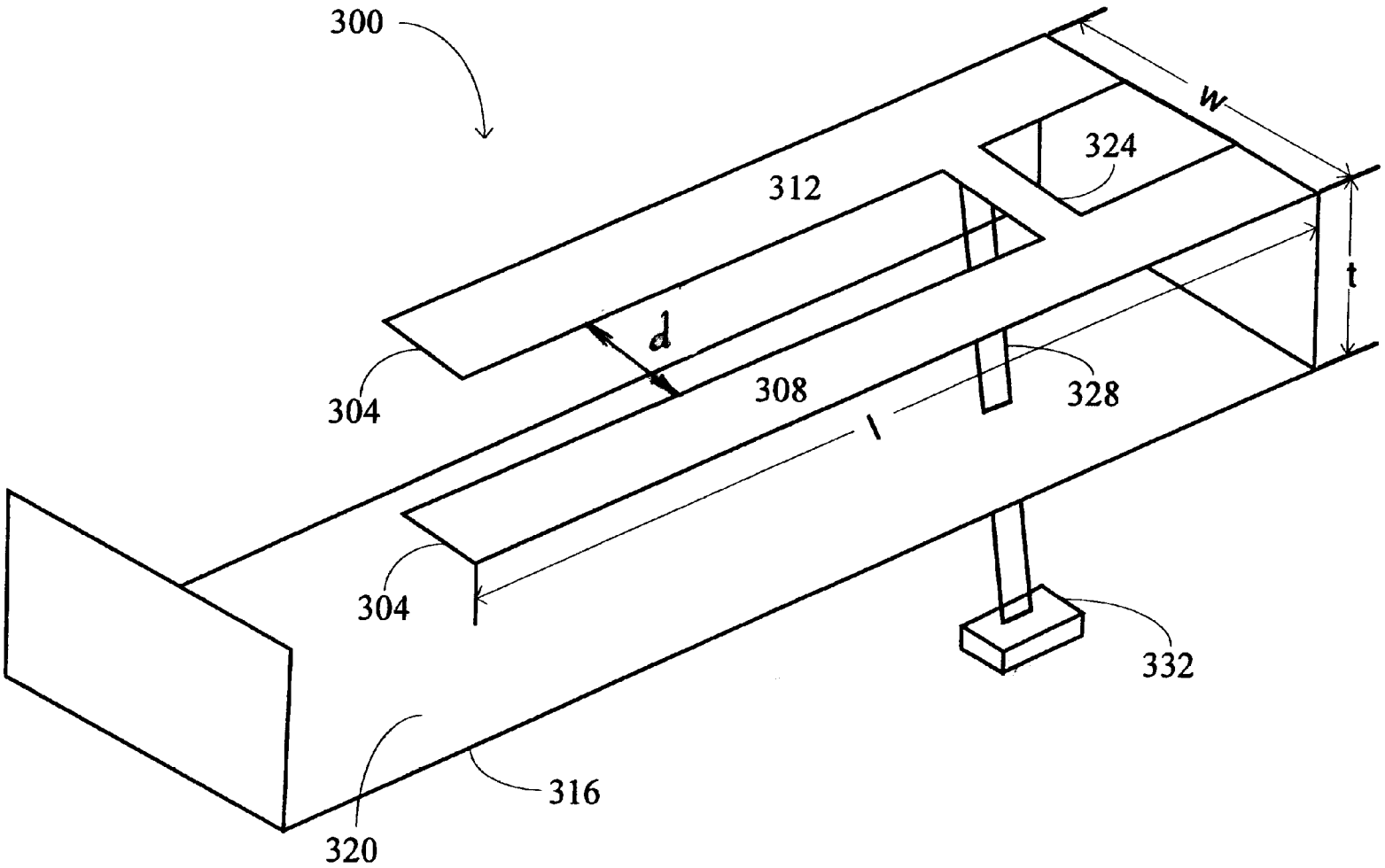
FIG. 3 illustrates an increased bandwidth quarter-wave patch antenna in accordance with the present invention.

The present invention achieves an increase in bandwidth over conventional patch antennas while retaining characteristics that are desirable for personal communication devices. The present invention is now described with reference to FIG. 3. FIG. 3 illustrates an increased bandwidth patch antenna 300 in accordance with one embodiment of the present invention. The embodiment illustrated in FIG. 3 is a quarter-wave patch antenna. Specifically, the embodiment illustrated in FIG. 3 comprises a conductor plate 304 having first and second arms 308 and 312, a ground plane 316, a dielectric substrate 320, a bridge 324, a probe 328 and a signal unit 332.

Note that signal unit 332 is used herein to refer to the functionality provided by a signal source and/or a signal receiver. Whether signal unit 332 provides one or both of these functionalities depends upon how antenna 300 is configured to operate. Antenna 300 described herein could, for example, be configured to operate solely as a transmitter, in which case signal unit 332 operates as a signal source. Alternatively, signal unit 332 operates as a signal receiver when antenna 300 is configured to operate solely as a receiver. Signal unit 332 provides both functionalities (e.g., a transceiver) when antenna 300 is configured to operate as both a transmitter and receiver. Those skilled in the art will recognize the various ways in which the functionality of generating and/or receiving signals might be implemented.

Conductor plate 304 is comprised of first and second arms 308 and 312. First arm 308 is a radiating arm (a radiating element) and second arm 312 is a tuning arm (a tuning element). By varying the length of second arm 312, the bandwidth of antenna 300 is increased. Also, by varying the length of second arm 312, the input impedance of antenna 300 can be matched with an input circuit. Thus, second arm 312 provides a convenient way to increase the bandwidth and match the input impedance of patch antenna 300 with an input circuit. This allows the added flexibility of being able to closely match the impedance of antenna 300 with particular circuits.

Furthermore, second arm 312 acts as a parasitic arm of first arm 308 due to a field effect. By acting as the parasitic arm of first arm 308, second arm 312 increases the gain of antenna 300. The parasitic arm also increases the bandwidth of antenna 300 by increasing the overall volume of antenna 300.

Because first arm 308 is the radiating arm of quarter-wave patch antenna 300, its length is set at approximately a fourth of a wavelength. Depending on a particular application, the length of second arm 312 may be longer or shorter than that of first arm 308.

First and second arms 308 and 312 are approximately planar to each other and are separated by an air gap of a distance d. If d is too small, first and second arms 308 and 312 are too close to each other, and there is excessive coupling between first and second arms 308 and 312. As d approaches zero, first and second arms 308 and 312 act like a single antenna. This prevents second arm 312 from functioning as a tuning arm as well as a parasitic arm of first arm 308. On the other hand, if d is too large, coupling between first and second arms 308 and 312 is negligible. Consequently, second arm 312 ceases to be a parasitic arm. In practice, d is kept small because it makes the antenna small in size which is desirable in a personal communication device.

Ground plane 316 is made of a conductive material such as, for example, aluminum, copper, gold, silver or brass. Ground plane 316 is separated from conductor plate 304 by dielectric substrate 320 and is approximately parallel to conductor plate 304. One end of conductor plate 304 is electrically connected to ground plane 316. The overall length of antenna 300 can be reduced in size by bending a portion of ground plane 316 near the edge at a 90 degree angle.

In one embodiment of the present invention, air is selected as dielectric substrate 320. Air has a dielectric constant of approximately 1 and it produces a negligible dielectric loss. Because the personal communication devices are typically powered by batteries that have limited energy storage capability, it is important to reduce dielectric loss in antenna 300. Thus, air is selected as a preferred dielectric substrate because it produces a negligible dielectric loss.

Probe 328 couples signal unit 332 to bridge 324. Signal unit 332 provides antenna 300 with a signal having a selected frequency band. In a PCS phone, the frequency band is generally 1.85–1.99 GHz. In a cellular phone, the frequency band is generally 824–894 MHz. First arm 308 (the radiating arm) receives the signal because it is sized appropriately for the selected frequency band, and it resonates at the selected frequency band.

The height of antenna 300 is determined by the thickness t of dielectric substrate 320. As before, if t is too small, conductor plate 304 is too close to ground plane 316. As a result, a surface current induced in ground plane 316 tends to be very strong which results in high ohmic loss in ground plane 316. Consequently, the efficiency of antenna 300 is degraded. If on the other hand, t is too large, surface wave modes are excited which degrades the antenna's performance.

Also, the bandwidth of antenna 300 is proportional to the thickness t of dielectric substrate 320. The thicker the substrate, the wider the antenna's bandwidth. While increasing t may seem like an easy way to increase the bandwidth of antenna 300, practical considerations dictate that t be small. A small t allows antenna 300 to have a low profile, which makes it suitable for portable devices such as a personal communication device. Thus, antenna designers have in the past reluctantly settled for a narrow bandwidth in order to make the antenna smaller in size.

The present invention allows increased bandwidth without increasing t. As noted before, in the present invention, the bandwidth of antenna 300 can be increased by adjusting the length of second arm 312 (the tuning arm). Also, as noted before, second arm 312 acts as a parasitic arm which increases the overall volume of antenna 300. Consequently, the bandwidth of antenna 300 is increased even further.

Additionally, the present invention allows dual frequency band operation when second arm 312 is excited with a second frequency band while first arm 308 is also being excited by a first frequency band. In this mode, first and second arms 308 and 312 are each excited with separate frequency bands. First arm 308 acts as a first active radiator and second arm 312 acts as a first tuning arm. Likewise, second arm 312 acts as a second active radiator and first arm 308 acts as a second tuning arm.

The length of first arm 308 is approximately a fourth of a wavelength of the first frequency. Likewise, the length of second arm 312 is approximately a fourth of a wavelength of the second frequency. Thus, the lengths of first and second arms 308 and 312 are sized appropriately for the first and second frequency bands, respectively.

The length of second arm 312 may be longer or shorter than the length of first arm 308. If, for instance, the second frequency band is higher than the first frequency band, the length of second arm 312 is shorter than the length of first arm 308. If, on the other hand, the first frequency band is higher than the second frequency band, the length of second arm 312 is longer than the length of first arm 308.

Bridge 324 electrically connects probe 328 to first and second arms 308 and 312. Bridge 324, thus, provides a convenient way to connect the signal source to first and second arms 308 and 312.

Signal unit 332 provides antenna 300 with two signals: a first signal having the first frequency band, and a second signal having the second frequency band. In operation, first arm 308 receives the first signal and resonates at the first frequency band. First arm 308 resonates at the first frequency band because it is sized appropriately (a fourth of a wavelength of the first frequency). Likewise, second arm 312 resonates at the second frequency band because it is sized appropriately for the second frequency band.

As noted before, the present invention allows antenna 300 to have a wider bandwidth than a conventional quarter-wave patch antenna of the same volume. For example, a conventional quarter-wave patch antenna having a length of 1.3 inches, a thickness of 0.25 inches and a width of 0.5 inches has a 2% bandwidth. In contrast, the present invention allows antenna 300 having generally the same dimensions to have a 7% bandwidth.

Figure 4:
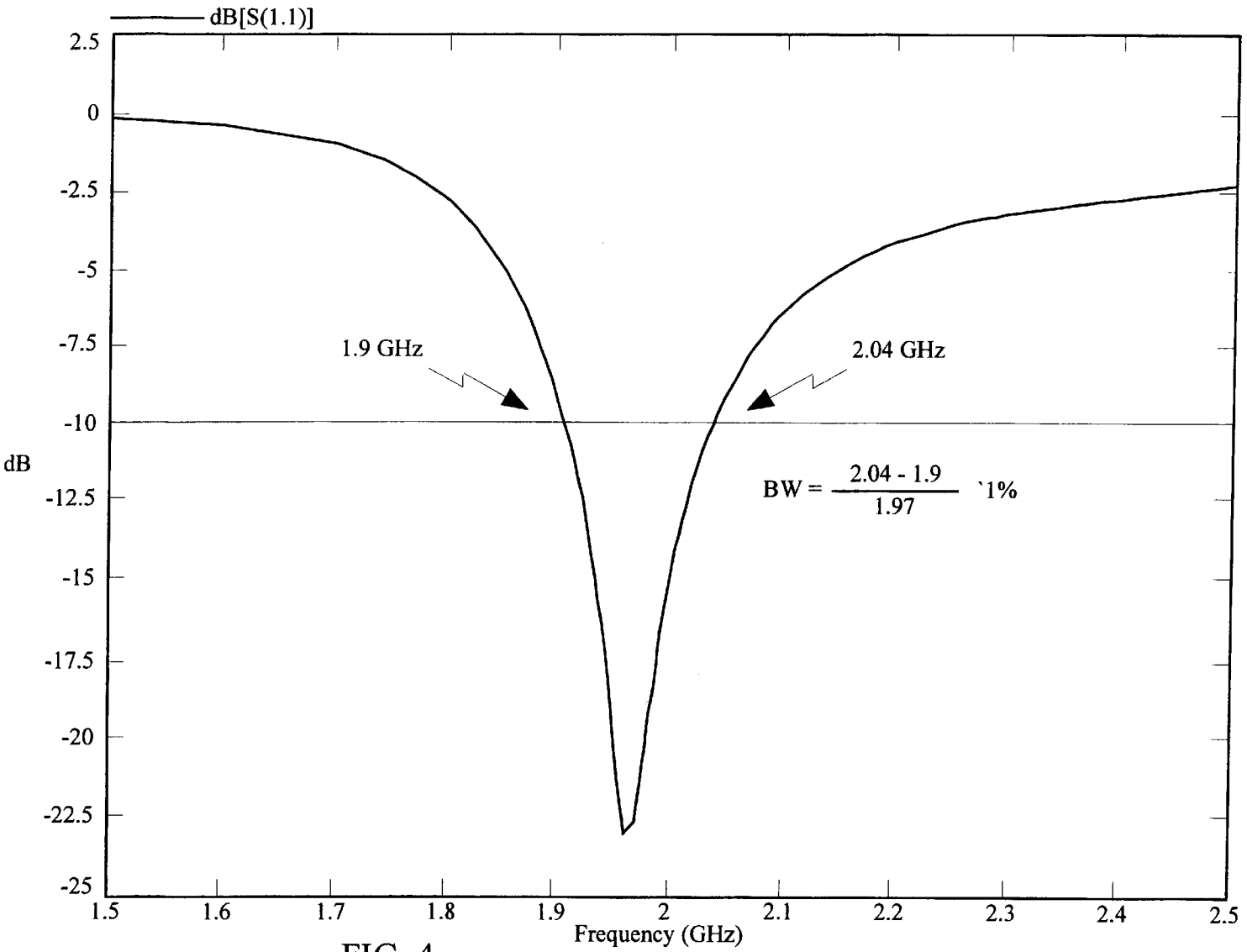
FIG. 4 depicts a computer simulated frequency response of the increased bandwidth quarter-wave patch antenna of FIG. 3.

In one example embodiment of the present invention, antenna 300 has the following dimensions: the length of first arm 308 is 1.30 inches; the length of second arm 312 is 1.10 inches; the overall width w is 0.5 inches; the thickness t is 0.25 inches; the length of ground plane 316 is 2.0 inches with a portion of the length (0.25 inches) being bent at a right angle; and the air gap d is 0.2 inches. First arm 308 is the radiating arm and second arm 312 is the tuning arm. FIG. 4 depicts a computer simulated frequency response of the example embodiment. Antenna 300 has a 10 dB response at 1.9 GHz and 2.04 GHz (PCS frequencies). Thus, antenna 300 has a 7% bandwidth.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A patch antenna, comprising:

a radiating arm having a length of approximately a multiple of one quarter wavelength of an operating frequency of interest;

a tuning arm for determining a bandwidth of said patch antenna, said tuning arm having a length different from that of said radiating arm, said tuning arm and said radiating arm separated by an air gap;

a bridge connected to said radiating arm and to said tuning arm, said bridge connected to said radiating arm and to said tuning arm such that a portion of each of said arms extend in front of said bridge and behind said bridge; and a ground plane separated from said radiating arm and said tuning arm by a dielectric substrate.

2. The patch antenna according to claim 1, wherein said ground plane is substantially parallel to said radiating arm and said tuning arm.

3. The patch antenna according to claim 1, wherein said radiating arm and said tuning arm are electrically connected by said bridge.

4. The patch antenna according to claim 1, wherein said ground plane is electrically connected to one end of said radiating arm and to one end of said tuning arm.

5. The patch antenna according to claim 1, wherein a portion of said ground plane is bent at a 90 degree angle to reduce the overall length of said patch antenna.

6. The patch antenna according to claim 1, wherein the thickness of said dielectric substrate is less than or equal to $\lambda_g/_{10}$.

7. The patch antenna according to claim 1, wherein said radiating arm and said tuning arm are substantially parallel to one another.

8. The patch antenna of claim 1, further comprising a signal unit electrically coupled to said bridge for providing said patch antenna with a signal having a first frequency band.

* * * * *